US012789961B2

(12) United States Patent
Kim et al.

(10) Patent No.: US 12,789,961 B2
(45) Date of Patent: Nov. 10, 2026

(54) HULL-DIRECTED PROPULSION SYSTEM OF CONTRA-ROTATING PROPELLER AND METHOD FOR MANUFACTURING THE SAME

(71) Applicant: KOREA INSTITUTE OF OCEAN SCIENCE & TECHNOLOGY, Yeongdo-gu (KR)

(72) Inventors: Myoung-Soo Kim, Yuseong-gu (KR); Jung Hyung Park, Mokpo-si (KR)

(73) Assignee: Korea Institute of Ocean Science & Technology, Yeongdo-gu (KR)

( * ) Notice: Subject to any disclaimer, the term of this patent is extended or adjusted under 35 U.S.C. 154(b) by 0 days.

(21) Appl. No.: 19/202,772

(22) Filed: May 8, 2025

(65) Prior Publication Data

US 2025/0346333 A1 Nov. 13, 2025

(30) Foreign Application Priority Data

May 9, 2024 (KR) ..... 10-2024-0061078

(51) Int. Cl.
*B63H 5/10* (2006.01)
*B63H 21/17* (2006.01)

(52) U.S. Cl.
CPC ..... *B63H 5/10* (2013.01); *B63H 21/17* (2013.01); *B63H 2005/106* (2013.01)

(58) Field of Classification Search
CPC .... B63H 21/17; B63H 5/10; B63H 2023/245; B63H 2023/067
See application file for complete search history.

(56) References Cited

U.S. PATENT DOCUMENTS 1,534,725 A * 4/1925 Macmillan ..... B63H 23/24 415/60
5,117,141 A * 5/1992 Hawsey ..... H02K 21/24 310/156.36

(Continued)

FOREIGN PATENT DOCUMENTS

CN 104229113 A 12/2014
CN 104260868 A 1/2015

(Continued)

OTHER PUBLICATIONS

List of Foreign References and Their Translations, dated May 8, 2025. 3 pages.

(Continued)

*Primary Examiner* — Ryan C Clark
(74) *Attorney, Agent, or Firm* — Heslin Rothenberg Farley & Mesiti P.C.; George S. Blasiak, Esq.

(57) ABSTRACT

There is set forth herein a hull-directed propulsion system of a contra-rotating propeller and a method for manufacturing the same, in which the contra-rotating propulsion unit mounted on an electric propulsion vessel is directly connected to the hull. There is set forth herein a hull-directed propulsion system of a contra-rotating propulsion unit, comprising: a contra-rotating propulsion unit including a front propeller and a rear propeller; a dual-rotor electric motor configured to generate rotational directions of the front propeller and the rear propeller, respectively; and a dual shaft connecting the contra-rotating propulsion unit and the dual-rotor electric motor.

6 Claims, 5 Drawing Sheets

(56) References Cited

U.S. PATENT DOCUMENTS

| | | | | |
|---|---|---|---|---|
| 9,017,117 | B2 | 4/2015 | Lee et al. | |
| 9,017,119 | B2 | 4/2015 | Lee et al. | |
| 9,184,649 | B2 | 11/2015 | Webster | |
| 9,789,943 | B2 | 10/2017 | Lehmann | |
| 11,046,404 | B2 | 6/2021 | Lin et al. | |
| 12,362,638 | B2 | 7/2025 | Izumi et al. | |
| 2010/0236849 | A1* | 9/2010 | Wishart | H01R 39/381 310/115 |
| 2013/0181562 | A1 | 7/2013 | Gieras et al. | |
| 2021/0031892 | A1* | 2/2021 | Lin | H02K 16/02 |

FOREIGN PATENT DOCUMENTS

| | | | | | |
|---|---|---|---|---|---|
| CN | 106915426 | A | * | 7/2017 | B64D 27/24 |
| CN | 106927001 | A | * | 7/2017 | B64C 11/48 |
| CN | 107054597 | A | * | 8/2017 | B63H 5/10 |
| CN | 112960094 | A | | 6/2021 | |
| CN | 115158647 | A | * | 10/2022 | B64D 35/06 |
| DE | 102011053787 | A1 | * | 3/2013 | B63H 1/14 |
| EP | 2692629 | A1 | * | 2/2014 | H02K 55/00 |
| JP | 63-217968 | A | | 9/1988 | |
| JP | S63217968 | A | * | 9/1988 | |
| JP | H031728 | A | * | 1/1991 | |
| JP | H0318268 | A | | 1/1991 | |
| JP | 05-052133 | B2 | | 8/1993 | |
| JP | H5193563 | A | | 8/1993 | |
| JP | 09-240591 | A | | 9/1997 | |
| JP | H09323698 | A | * | 12/1997 | F02B 61/045 |
| JP | 2006081344 | A | * | 3/2006 | |
| JP | 2008001280 | A | * | 1/2008 | |
| JP | 2009292439 | A | * | 12/2009 | |
| JP | 2009113578 | A | | 12/2012 | |
| JP | 2013017389 | A | | 1/2013 | |
| JP | 2014507329 | A | | 3/2014 | |
| JP | 2015516921 | A | | 6/2015 | |
| JP | 2021180579 | A | | 11/2021 | |
| JP | 2022000359 | A | | 1/2022 | |
| KR | 20110053109 | A | | 5/2011 | |
| KR | 20140025004 | A | | 3/2014 | |
| KR | 20150065081 | A | | 6/2015 | |
| KR | 101606242 | B | | 3/2016 | |
| NO | 20170368 | A1 | * | 9/2018 | B63H 23/10 |
| WO | WO-2014088167 | A1 | * | 6/2014 | B63H 5/10 |
| WO | WO-2021229856 | A1 | * | 11/2021 | H02K 21/26 |

OTHER PUBLICATIONS

Korean Intellectual Property Office, Notice of Allowance, mailed in corresponding KR application 10-2024-0061078 on Apr. 1, 2025. 3 pages (w/ translation).

Korean Intellectual Property Office, Notice of Office Action, mailed in corresponding KR application 10-2024-0061078 on Jun. 25, 2024. 38 pages (w/translation).

Korean Intellectual Property Office, Notice of Decision of Rejection, mailed in corresponding KR Application 10-2024-0061078 on Dec. 26, 2024. 9 pages (w/translation).

Japan Patent Office, Notice of reasons for refusal dated Jun. 3, 2025 in corresponding JP application 2025-078344. 8 pages.

Taiwan Intellectual Property Office, Letter of Notification on Review Opinions of Intellectual Property Bureau of Ministry of Economic Affairs dated Jul. 22, 2025 in corresponding TW application 114116833. 4 pages.

List of Foreign References and Their Translation, dated Aug. 22, 2025. 2 pages.

List of Foreign References and Their Translation, dated Jan. 14, 2026. 2 pages.

Japan Patent Office, Notice of Reasons for Refusal in corresponding JP Application 2025-078344, dated Dec. 9, 2025. 21 pages (w/translation).

List of Foreign References and Their Translation, dated Jun. 29, 2026. 2 pages.

China National Intellectual Property Administration, Notice of the First Review Opinion issued in corresponding CN Application 202510587194.8, dated Apr. 11, 2026. 12 pages (w/translation).

* cited by examiner

【FIG. 1】
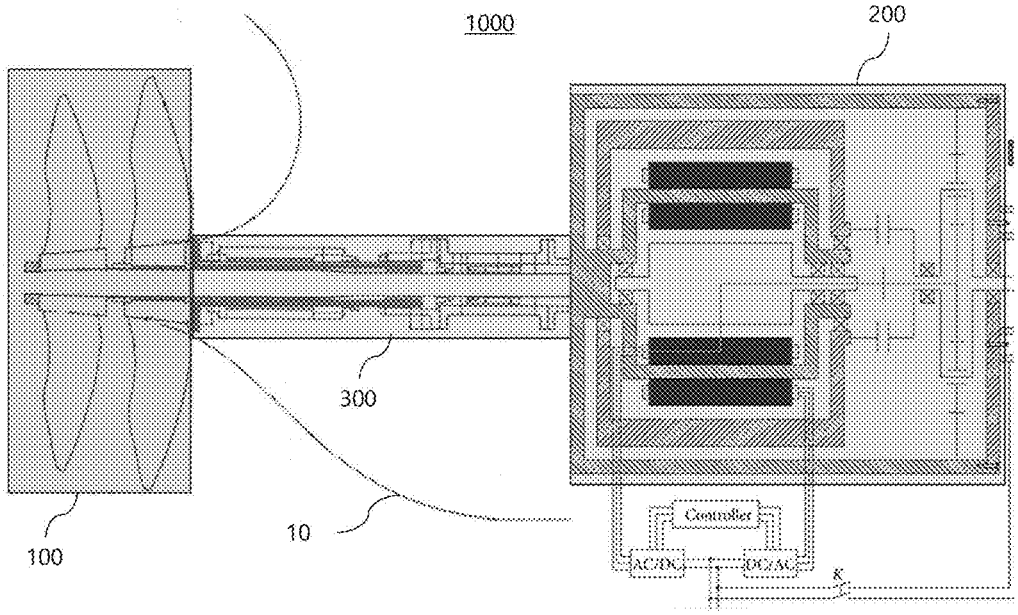

【FIG. 2】
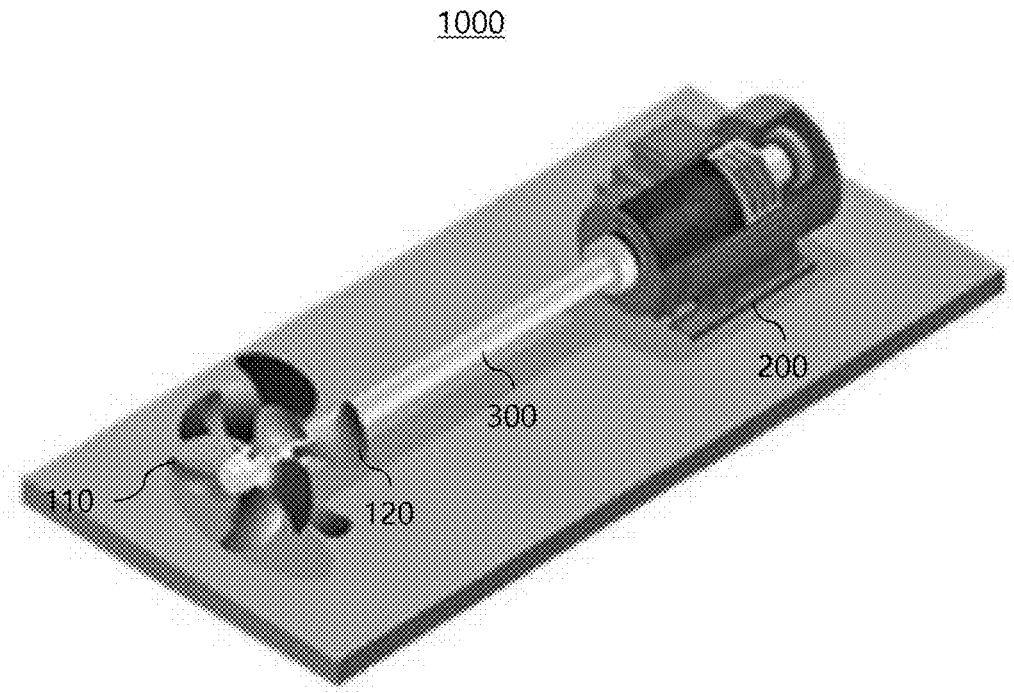

【FIG. 3】
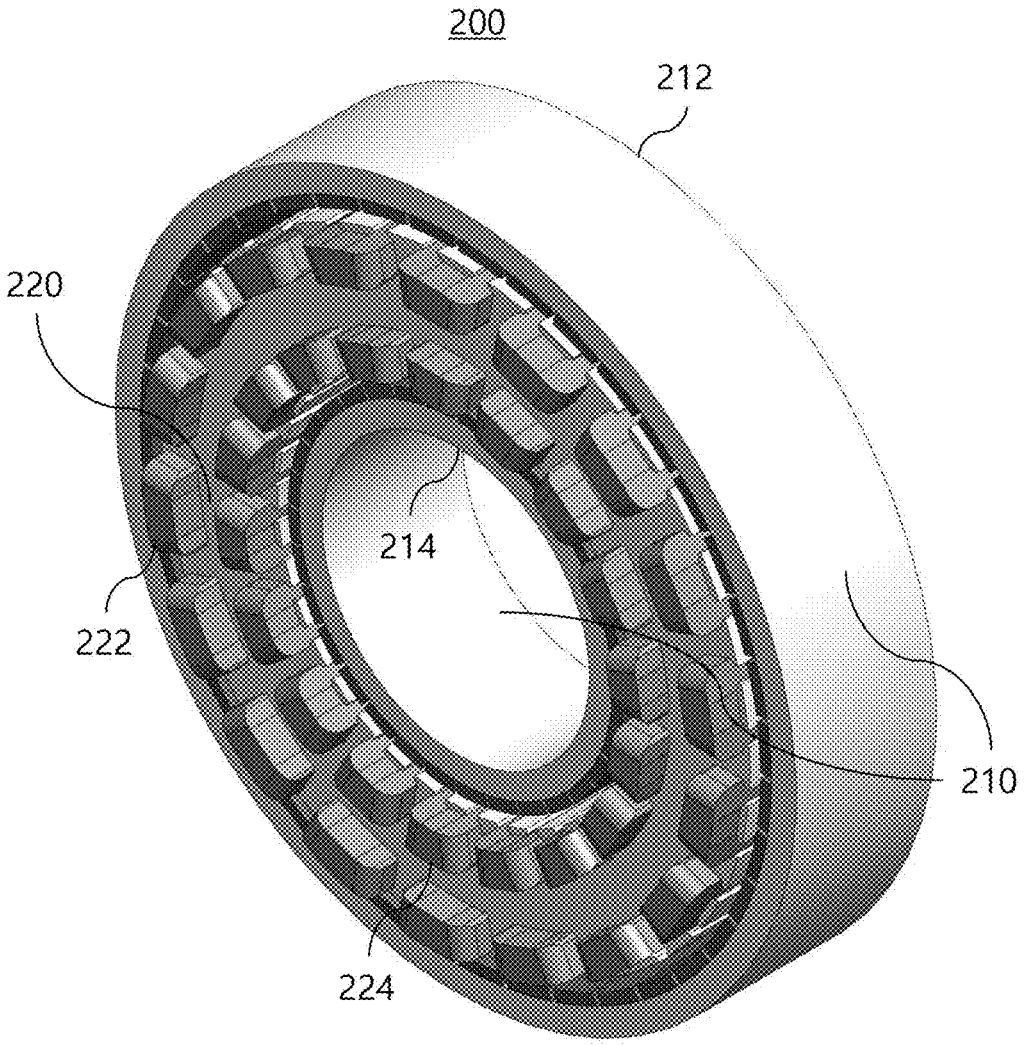

【FIG. 4】
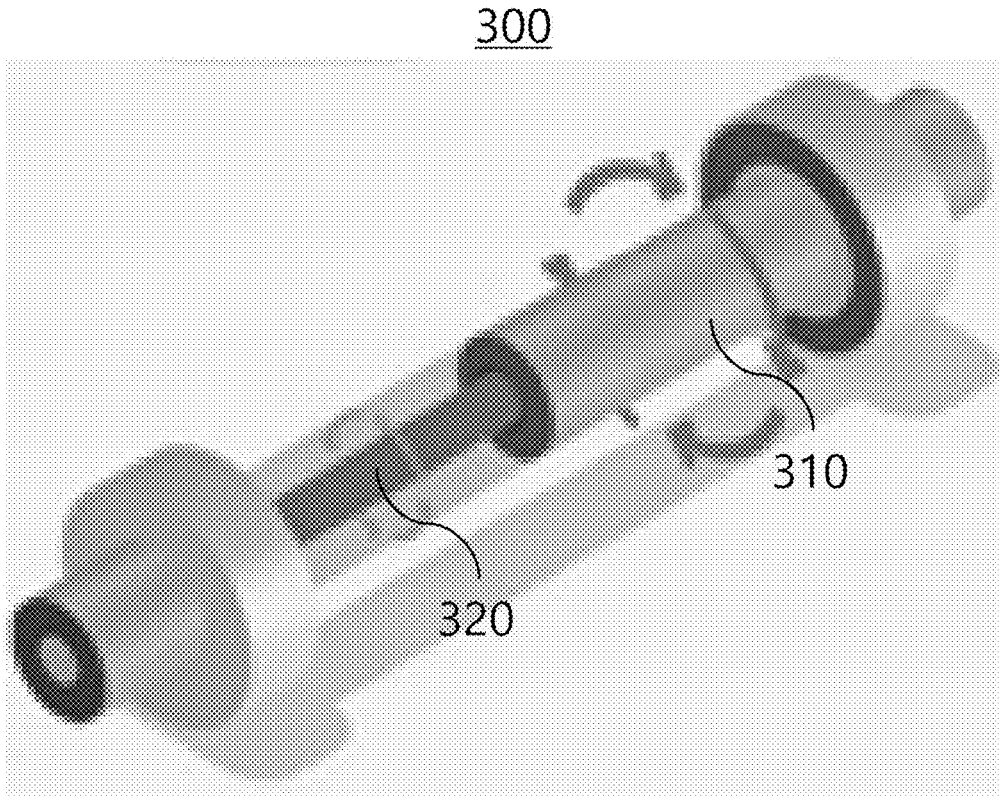

【FIG. 5】
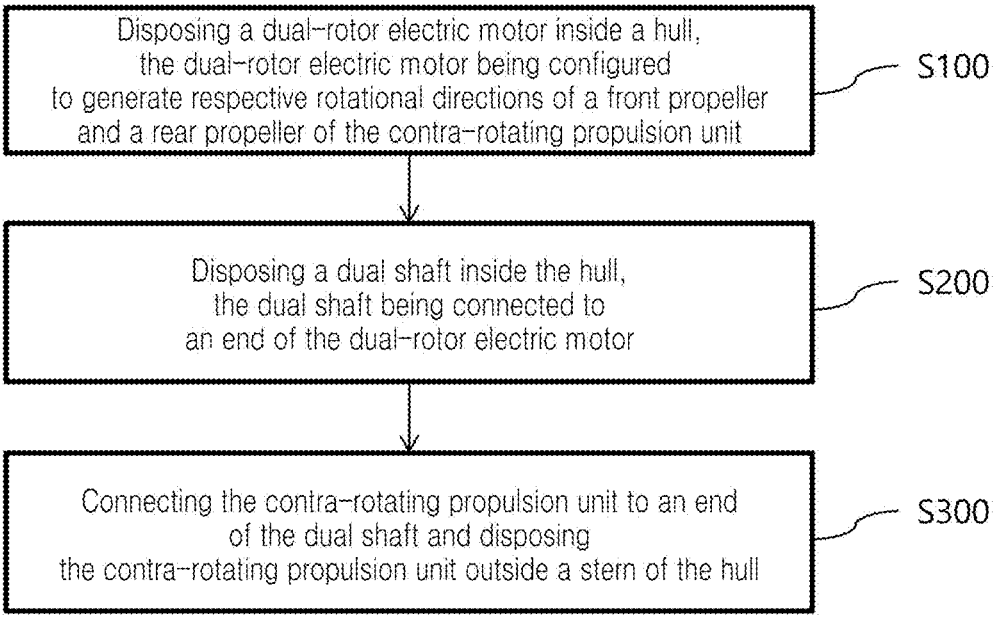

HULL-DIRECTED PROPULSION SYSTEM OF CONTRA-ROTATING PROPELLER AND METHOD FOR MANUFACTURING THE SAME

CROSS-REFERENCE TO RELATED APPLICATION

This application claims priority to Korean Patent Application No. 10-2024-0061078 filed on May 9, 2024, and all the benefits accruing therefrom under 35 U.S.C. § 119, the contents of which are incorporated herein by reference in their entirety.

BACKGROUND OF THE DISCLOSURE

1 Field of the Disclosure

The present disclosure relates to a hull-directed propulsion system of a contra-rotating propeller and a method for manufacturing the same. More particularly, the present disclosure relates to a hull-directed propulsion system including a contra-rotating propulsion unit mounted on an electric propulsion vessel. The system is configured such that the contra-rotating propulsion unit is directly connected to the hull, thereby significantly improving the propulsion efficiency of the vessel. In addition, by eliminating the gearbox required to realize the contra-rotation of the contra-rotating propulsion unit, the internal space of the vessel can be used for other purposes, and energy loss is reduced.

2 Description of the Related Art

A contra-rotating propeller refers to a propulsion system in which two propellers are arranged coaxially and rotate in opposite directions to generate thrust. It is primarily used in propulsion systems for ships and aircraft.

In such systems, the rotational turbulence generated by each propeller is naturally canceled out by the interaction between the two counter-rotating propellers.

As a result, contra-rotating propellers produce greater thrust and demonstrate superior straight-line propulsion performance compared to single-propeller systems, which use only one propeller. This significantly improves propulsion efficiency and greatly reduces vibration caused by rotational turbulence.

In general, marine propulsion systems using contra-rotating propellers include an inner shaft connected to a power source inside the hull, a rear propeller coupled to the rear end of the inner shaft, a hollow outer shaft rotatably installed around the outer surface of the inner shaft, and a front propeller coupled to the rear end of the outer shaft.

Here, a contra-rotating gear box is used to rotate the front propeller in the opposite direction to the rear propeller.

In conventional engine-powered vessels, gearboxes have been used to implement the counter-rotation of contra-rotating propellers due to constraints in engine rotation direction.

However, gearboxes, which rotate the two propellers in opposite directions, contribute to energy loss, thus lowering the propulsion efficiency of the contra-rotating propulsion system.

To address this problem, the conventional art discloses a contra-rotating propeller-type propulsion system that is driven by one or more electric motors without a gear mechanism. Compared to conventional systems driven by superconducting motors and gear mechanisms, this structure improves propulsion efficiency and reduces energy loss.

However, the aforementioned conventional art relies on a superconducting motor, which requires a cooling system to supply cryogenic coolant for maintaining the superconducting coil. This leads to increased energy loss and complicated maintenance in electric propulsion vessels.

Therefore, there is a strong need for research and development of an electric propulsion vessel equipped with a contra-rotating propulsion unit directly connected to the hull. By eliminating the gearbox and the associated lubrication system, and by implementing a dual-rotor configuration within the electric motor, it is possible to drive the contra-rotating propellers through a dual-shaft structure without the need for a gearbox, thereby enhancing the vessel's propulsion efficiency.

RELATED PATENT DOCUMENT

Korean Registered Patent No. 10-1380650
Korean Registered Patent No. 10-1606242
Korean Patent Publication No. 10-2014-0025004
Japanese Patent Publication No. 2022-000359

SUMMARY OF THE DISCLOSURE

The purpose of the present disclosure, which aims to solve the aforementioned conventional problems, is to provide a hull-directed propulsion system of a contra-rotating propeller and a method for manufacturing the same, in which the contra-rotating propulsion unit mounted on an electric propulsion vessel is directly connected to the hull, thereby significantly improving the propulsion efficiency of the electric propulsion vessel.

In addition, the purpose of the present disclosure is to provide a hull-directed propulsion system of a contra-rotating propeller and a method for manufacturing the same, in which a dual-rotor is implemented within the electric motor, thereby enabling a dual-shaft structure without a gearbox. This configuration allows the internal space of the vessel to be utilized for other purposes, reduces energy loss, and facilitates easy maintenance.

In order to achieve the purpose, an aspect of the present disclosure provides a hull-directed propulsion system of a contra-rotating propulsion unit, comprising: a contra-rotating propulsion unit including a front propeller and a rear propeller; a dual-rotor electric motor configured to generate rotational directions of the front propeller and the rear propeller, respectively; and a dual shaft connecting the contra-rotating propulsion unit and the dual-rotor electric motor.

In some exemplary embodiments, the contra-rotating propulsion unit may be connected to the dual shaft located at a stern of the hull and may be disposed outside the stern.

In some exemplary embodiments, the contra-rotating propulsion unit may be configured such that the front propeller and the rear propeller are disposed on the dual shaft and rotate in opposite directions, respectively.

In some exemplary embodiments, the dual-rotor electric motor may be configured such that a rotor and a stator are sequentially arranged in a pair to rotate the contra-rotating propulsion unit, and the rotor may be configured to operate through induced power.

In some exemplary embodiments, the rotor may include: an outer rotor disposed outside the dual-rotor electric motor and configured to rotate in one direction; and an inner rotor configured to rotate in another direction opposite to the one direction.

In some exemplary embodiments, the rotor may include a permanent magnet or a rotor core in the outer rotor and the inner rotor.

In some exemplary embodiments, the stator may include an outer coil configured to control the outer rotor and an inner coil configured to control the inner rotor.

In some exemplary embodiments, when the outer coil and the inner coil are used simultaneously, the stator is configured as a single stator.

In some exemplary embodiments, when the outer coil and the inner coil are used independently, the stator is configured as a plurality of stators.

In some exemplary embodiments, the dual shaft may be connected to an end of the dual-rotor electric motor.

In some exemplary embodiments, one side the dual shaft may be configured to rotate in one direction, and another side of the dual shaft may be configured to rotate in another direction opposite to the one direction.

In some exemplary embodiments, the dual shaft may be connected to an end of the dual-rotor electric motor, and may include an outer shaft and an inner shaft.

In some exemplary embodiments, the outer shaft and the inner shaft may be configured to rotate in opposite directions, respectively.

In some exemplary embodiments, the dual shaft may include a bearing disposed at one side where the outer shaft meets the hull, and the bearing may be configured to support the outer shaft and the inner shaft.

In addition, in order to achieve the purpose, another aspect of the present disclosure provides a method for manufacturing a hull-directed propulsion system of a contra-rotating propulsion unit, comprising: (a) disposing a dual-rotor electric motor inside a hull, the dual-rotor electric motor being configured to generate respective rotational directions of a front propeller and a rear propeller of the contra-rotating propulsion unit; (b) disposing a dual shaft inside the hull, the dual shaft being connected to an end of the dual-rotor electric motor; and (c) connecting the contra-rotating propulsion unit to an end of the dual shaft and disposing the contra-rotating propulsion unit outside a stern of the hull.

In some exemplary embodiments, in step (a), a rotor and a stator may be sequentially arranged in a pair in the dual-rotor electric motor, and the rotor may be configured to operate through induced power.

Specific details of other exemplary embodiments are included in "Details for carrying out the invention" and accompanying "drawings".

Advantages and/or features of the present disclosure, and a method for achieving the advantages and/or features will become obvious with reference to various exemplary embodiments to be described below in detail together with the accompanying drawings.

However, the present disclosure is not limited only to a configuration of each exemplary embodiment disclosed below, but may also be implemented in various different forms. The respective exemplary embodiments disclosed in this specification are provided only to complete disclosure of the present disclosure and to fully provide those skilled in the art to which the present disclosure pertains with the category of the present disclosure, and the present disclosure will be defined only by the scope of each claim of the claims.

According to the present disclosure, by configuring the contra-rotating propulsion unit as a hull-directed structure, the propulsion efficiency of the vessel is improved. Furthermore, by implementing a dual-shaft structure without a gearbox, the internal space of the vessel can be utilized for other purposes, energy loss is reduced, and maintenance becomes easier.

BRIEF DESCRIPTION OF THE DRAWINGS

FIG. 1 is a cross-sectional view showing a state in which a propulsion system according to an exemplary embodiment of the present disclosure is applied to a vessel.

FIG. 2 is a conceptual diagram illustrating the concept of a propulsion system according to an exemplary embodiment of the present disclosure.

FIG. 3 is a configuration diagram illustrating the structure of a dual-rotor electric motor according to an exemplary embodiment of the present disclosure.

FIG. 4 is a conceptual diagram illustrating the concept of a dual shaft according to an exemplary embodiment of the present disclosure.

FIG. 5 is a flowchart illustrating a method for manufacturing the propulsion system according to an exemplary embodiment of the present disclosure.

DETAILED DESCRIPTION OF THE DISCLOSURE

Before describing the present disclosure in detail, the terms or words used in this specification should not be construed as being unconditionally limited to their ordinary or dictionary meanings, and in order for the inventor of the present disclosure to describe his/her disclosure in the best way, concepts of various terms may be appropriately defined and used, and furthermore, the terms or words should be construed as means and concepts which are consistent with a technical idea of the present disclosure.

That is, the terms used in this specification are only used to describe preferred embodiments of the present disclosure, and are not used for the purpose of specifically limiting the contents of the present disclosure, and it should be noted that the terms are defined by considering various possibilities of the present disclosure.

As used herein, the term "hull-directed" means that a configuration in which a system or a unit is directly coupled or connected to the hull.

Further, in this specification, it should be understood that, unless the context clearly indicates otherwise, the expression in the singular may include a plurality of expressions, and similarly, even if it is expressed in plural, it should be understood that the meaning of the singular may be included.

In the case where it is stated throughout this specification that a component "includes" another component, it does not exclude any other component, but may further include any other component unless otherwise indicated.

Furthermore, it should be noted that when it is described that a component "exists in or is connected to" another component, this component may be directly connected or installed in contact with another component, and in inspect to a case where both components are installed spaced apart from each other by a predetermined distance, a third component or means for fixing or connecting the corresponding component to the other component may exist, and the description of the third component or means may be omitted.

On the contrary, when it is described that a component is "directly connected to" or "directly accesses" to another component, it should be understood that the third element or means does not exist.

Similarly, it should be construed that other expressions describing the relationship of the components, that is, expressions such as "between" and "directly between" or "adjacent to" and "directly adjacent to" also have the same purpose.

In addition, it should be noted that if terms such as "one side surface", "other side surface", "one side", "other side", "first", "second", etc., are used in this specification, the terms are used to clearly distinguish one component from the other component and a meaning of the corresponding component is not limited used by the terms.

Further, in this specification, if terms related to locations such as "upper", "lower", "left", "right", etc., are used, it should be understood that the terms indicate a relative location in the drawing with respect to the corresponding component and unless an absolute location is specified for their locations, these location-related terms should not be construed as referring to the absolute location.

Further, in this specification, in specifying the reference numerals for each component of each drawing, the same component has the same reference number even if the component is indicated in different drawings, that is, the same reference number indicates the same component throughout the specification.

In the drawings attached to this specification, a size, a location, a coupling relationship, etc. of each component constituting the present disclosure may be described while being partially exaggerated, reduced, or omitted for sufficiently clearly delivering the spirit of the present disclosure, and thus the proportion or scale may not be exact.

Further, hereinafter, in describing the present disclosure, a detailed description of a configuration determined that may unnecessarily obscure the subject matter of the present disclosure, for example, a detailed description of a known technology including the prior art may be omitted.

Hereinafter, exemplary embodiments of the present disclosure will be described in detail with reference to related drawings.

FIG. 1 is a cross-sectional view showing a state in which a propulsion system according to an exemplary embodiment of the present disclosure is applied to a vessel, and FIG. 2 is a conceptual diagram illustrating the concept of a propulsion system according to an exemplary embodiment of the present disclosure.

Referring to FIGS. 1 and 2, a hull-directed propulsion system of a contra-rotating propulsion unit according to an exemplary embodiment of the present disclosure may include a contra-rotating propulsion unit 100, a dual-rotor electric motor 200, and a dual shaft 300.

The hull-directed propulsion system of the contra-rotating propulsion unit according to the exemplary embodiment of the present disclosure provides a device capable of increasing the propulsion efficiency of a hull 10 by disposing the contra-rotating propulsion unit 100 at a rear end outside a stern of the hull 10.

In particular, as shown in FIGS. 1 and 2, the contra-rotating propulsion unit 100 according to the exemplary embodiment of the present disclosure includes a front propeller 110 and a rear propeller 120. The front propeller 110 and the rear propeller 120 may be disposed in parallel on the dual shaft 300 positioned at a rear end outside the stern of the hull 10. The front propeller 110 and the rear propeller 120 may rotate respectively in different directions (e.g., clockwise and counterclockwise).

The contra-rotating propulsion unit 100 according to the exemplary embodiment of the present disclosure may be connected to the second side of the dual shaft 300 opposite to the first side of the dual shaft 300, where the first side of the dual shaft 300 is connected to the dual-rotor electric motor 200. As a result, the rotation generated by the dual-rotor electric motor 200 may be transmitted to the contra-rotating propulsion unit 100 through the dual shaft 300, thereby enabling the front propeller 110 and the rear propeller 120 included in the contra-rotating propulsion unit 100 to rotate in opposite directions, respectively.

Specifically, the front propeller 110 of the contra-rotating propulsion unit 100 may be connected to an outer shaft 310 of the dual shaft 300, which is connected to the dual-rotor electric motor 200 located inside the hull. The rear propeller 120 of the contra-rotating propulsion unit 100 may be connected to an inner shaft 320 of the dual shaft 300, which is also connected to the dual-rotor electric motor 200.

Here, the rotational motion generated by the dual-rotor electric motor 200 is transmitted to the contra-rotating propulsion unit 100, allowing the front propeller 110 and the rear propeller 120 to rotate in opposite directions, respectively.

However, the present disclosure is not limited thereto. Thus, the contra-rotating propulsion unit 100 may refer to a device in which the front propeller 110 and the rear propeller 120 are respectively connected to the outer shaft 310 and the inner shaft 320 of the dual shaft 300.

Meanwhile, due to the opposite-direction rotation of the propellers in the contra-rotating propulsion unit 100, the wake flow discharged from the front propeller 110 increases the angle of attack generated on the cross-section of the rear propeller 120, and reduces the flow velocity component in the rotational direction, thereby improving the lift-to-drag ratio of the cross-section of the rear propeller 120.

Conversely, in the contra-rotating propulsion unit 100 according to an exemplary embodiment of the present disclosure, the rear propeller 120 may intake the wake flow and rectify the turbulence caused by the rear blades of the front propeller 110, thus improving the lift-to-drag ratio of the front propeller 110.

Here, the lift-to-drag ratio may refer to the ratio of lift generated in the forward direction of the moving body to the resistance generated in the opposite direction due to air or water.

The contra-rotating propulsion unit 100 according to an exemplary embodiment of the present disclosure may be directly connected to a stern boss of the hull, and as the lift-to-drag ratio improves, may have the effect of increasing the propulsion efficiency of the vessel.

In addition, as shown in FIGS. 1 and 2, the contra-rotating propulsion unit 100 according to an exemplary embodiment of the present disclosure may be connected to an end of the dual shaft 300 positioned at a rear end of the hull 10, and may be disposed outside a stern of the hull 10.

In particular, the contra-rotating propulsion unit 100 according to an exemplary embodiment of the present disclosure may be directly connected to a portion (e.g., a stern boss) streamlined and protruding rearward from the hull 10, in order to support the dual shaft 300.

When the contra-rotating propulsion unit 100 according to an exemplary embodiment of the present disclosure is connected to the end of the dual shaft 300 positioned at the stern boss of the hull 10 and is directly mounted on the stern boss, the disturbance of inflow caused by other structural elements of the hull (e.g., a housing or a strut) can be reduced, and the flow passing through the hull can be introduced directly into the contra-rotating propulsion unit 100.

Accordingly, the hull-directed propulsion system 1000 of the contra-rotating propulsion unit according to an exemplary embodiment of the present disclosure can increase the propulsion efficiency of the contra-rotating propulsion unit 100 by designing the front propeller 110 and the rear propeller 120 in accordance with the direction of the inflow, as the influence (e.g., inflow disturbance) caused by other structures of the hull is reduced.

FIG. 3 is a configuration diagram illustrating the structure of a dual-rotor electric motor according to an exemplary embodiment of the present disclosure.

Referring to FIG. 3, a hull-directed propulsion system of a contra-rotating propulsion unit according to an exemplary embodiment of the present disclosure may include a dual-rotor electric motor 200 including a rotor 210 and a stator 220.

Here, the rotor 210 may rotate due to current induced by the magnetic field generated by the stator 220, thereby producing mechanical rotational power, and the stator 220 may refer to a device that generates a magnetic field when current flows through a coil.

Meanwhile, the dual-rotor electric motor 200 according to an exemplary embodiment of the present disclosure may be configured such that the rotor 210 and the stator 220 are sequentially arranged in a pair to rotate the contra-rotating propulsion unit 100.

In particular, the dual-rotor electric motor 200 is connected to one side of the dual shaft 300, generates rotational power through the operation of the rotor 210 and the stator 220, and transmits the generated rotational power to the contra-rotating propulsion unit 100 through the dual shaft 300, thereby enabling the front propeller 110 and the rear propeller 120 of the contra-rotating propulsion unit 100 to rotate. Here the contra-rotating propulsion unit 100 is connected to the other side of the dual shaft (300).

In addition, the dual-rotor electric motor 200 may employ an induction motor using induced power or a motor using permanent magnets.

According to an exemplary embodiment of the present disclosure, the dual-rotor electric motor 200 may be a device using an induction motor in which the induced power drives sequentially arranged pair of the rotor 210 and the stator 220.

The rotor 210 according to an exemplary embodiment of the present disclosure may include an outer rotor 212 and an inner rotor 214.

In particular, the outer rotor 212 may be disposed at the outer periphery of the dual-rotor electric motor 200 and may rotate in one direction through the stator 220 paired with the outer rotor 212.

Likewise, the inner rotor 214 may be disposed inside the dual-rotor electric motor 200 and may rotate in a direction opposite to the one direction of rotation of the outer rotor 212 through the stator 220 paired with the inner rotor 214.

Here, the rotational directions of the outer rotor 212 and the inner rotor 214 may correspond to the rotational directions of the front propeller 110 and the rear propeller 120 of the contra-rotating propulsion unit 100, respectively.

In addition, each of the outer rotor 212 and the inner rotor 214 may include a permanent magnet or a rotor core (armature core).

Meanwhile, the stator 220 according to an exemplary embodiment of the present disclosure may include an outer coil 222 and an inner coil 224.

Here, the outer coil 222 may control the rotation of the outer rotor 212, and the inner coil 224 may control the rotation of the inner rotor 214.

In particular, the rotational operation of the outer rotor 212 may be controlled by the outer coil 222 of the stator 220 that forms a pair with the outer rotor 212.

Likewise, the rotational operation of the inner rotor 214 may be controlled by the inner coil 224 of the stator 220 that forms a pair with the inner rotor 214.

Furthermore, when the outer coil 222 and the inner coil 224 are used simultaneously, the stator 220 may be configured as a single stator 200. when the outer coil 222 and the inner coil 224 are used separately, the stator 220 may be configured as a plurality of stators.

For example, when the outer coil 222 and the inner coil 224 are used simultaneously, the rotation of the outer rotor 212 and the inner rotor 214 can be controlled only by controlling the current direction in each of the outer coil 222 and the inner coil 224. Therefore, the stator 220 may be configured as a single stator 200.

In contrast, when the outer coil 222 and the inner coil 224 are used independently, not only the direction of current in each of the outer coil 222 and the inner coil 224, but also insulation between the outer coil 222 and the inner coil 224 as well as the fastening of bearings must be considered. Therefore, the stator 220 may be configured as a plurality of stators 220.

In addition, the dual-rotor electric motor 200 according to an exemplary embodiment of the present disclosure may include a pair of rotor 210 and stator 220 sequentially arranged and operating via induced power, wherein the distance between the rotor 210 and the stator 220, the number of magnets included in the dual-rotor electric motor 200, and the number of coils may be varied.

That is, the dual-rotor electric motor 200 has a structure in which coils are sequentially arranged. Merely by controlling current and voltage, the dual-rotor electric motor 200 allows continuous control of the outer shaft 310 and the inner shaft 320 of the dual shaft 300 connected to the dual-rotor electric motor 200.

Through such a configuration of the dual-rotor electric motor 200, even in marine environments where electric propulsion vessels are affected by complex external conditions, the degree of control freedom of the propulsion system 1000 can be increased, maintenance can be simplified, and energy loss can be reduced due to improved propulsion efficiency.

FIG. 4 is a conceptual diagram illustrating the concept of a dual shaft according to an exemplary embodiment of the present disclosure.

Referring to FIG. 4, a dual shaft 300 of the hull-directed propulsion system of the contra-rotating propulsion unit according to an exemplary embodiment of the present disclosure may include an outer shaft 310 and an inner shaft 320.

The dual shaft 300 according to an exemplary embodiment of the present disclosure may be configured such that the outer shaft 310 and the inner shaft 320 are respectively connected to an outer rotor 212 and an inner rotor 214 of the dual-rotor electric motor 200, and rotate in respectively opposite directions by rotational power generated from the dual-rotor electric motor 200.

In addition, in the dual shaft 300 according to an exemplary embodiment of the present disclosure, a bearing configured to support the outer shaft 310 and the inner shaft 320 may be disposed at a side where the outer shaft 310 meets the hull 10.

In particular, the outer shaft 310 and the inner shaft 320 may be configured to be connected to a bearing connected to the dual-rotor electric motor 200. The outer shaft 310 and the inner shaft 320 may transmit the rotational power generated by the operation of the dual-rotor electric motor 200 to the contra-rotating propulsion unit 100.

For the sake of explanation, a device or component that connects the outer shaft 310 and the inner shaft 320 is described as a bearing in this exemplary embodiment of the present disclosure. However, the present disclosure is not limited thereto, and any device or component made of metal that connects and separates the outer shaft 310 and the inner shaft 320 may be used as the bearing.

When the bearing for connecting or supporting the outer shaft 310 and the inner shaft 320 is not installed on the dual shaft 300, the magnetic poles (N and S) continuously change due to the rotation of the dual-rotor electric motor 200. This may cause a problem in which the inner rotor 214, which drives the inner shaft 320, rotates in the air due to noise (e.g., magnetic interference) generated from the dual-rotor electric motor 200.

However, the hull-directed propulsion system 1000 of the contra-rotating propulsion unit according to an exemplary embodiment of the present disclosure may reduce noise between the dual-rotor electric motor 200 and the dual shaft 300 by including a bearing that connects or supports the outer shaft 310 and the inner shaft 320.

In other words, the dual shaft 300 of the exemplary embodiment may be a device that extends from the dual-rotor electric motor 200 located inside the hull 10 to the stern boss of the hull 10, thereby connecting the dual-rotor electric motor 200 to the contra-rotating propulsion unit 100.

In addition, the dual shaft 300 according to an exemplary embodiment of the present disclosure may implement contra-rotation of the propellers of the contra-rotating propulsion unit 100 by realizing dual rotors within the dual-rotor electric motor 200, thereby replacing a contra-rotating gear box which was previously used to implement contra-rotation.

Accordingly, as the dual shaft 300 replaces a contra-rotating gear box, the hull-directed propulsion system 1000 of the contra-rotating propulsion unit according to an exemplary embodiment of the present disclosure may achieve a simplified shaft configuration compared to ships equipped with gearboxes, by eliminating the gearbox and the lubrication system associated therewith.

As a result, the hull-directed propulsion system 1000 according to an exemplary embodiment of the present disclosure may improve the control flexibility of the hull propulsion system and provide an advantage in ease of maintenance, even when an electric propulsion vessel is affected by complex marine environments.

FIG. 5 is a flowchart illustrating a method for manufacturing the propulsion system according to an exemplary embodiment of the present disclosure.

Referring to FIG. 5, a method for manufacturing a hull-directed propulsion system of a contra-rotating propulsion unit according to an exemplary embodiment of the present disclosure may include:

step S100 of disposing a dual-rotor electric motor 200 inside a hull (10), wherein the dual-rotor electric motor 200 is configured to generate respective rotational directions of a front propeller 110 and a rear propeller 120 of a contra-rotating propulsion unit 100;

step S200 of disposing a dual shaft 300 inside the hull 10, wherein the dual shaft 300 is connected to an end of the dual-rotor electric motor 200; and step S300 of connecting the contra-rotating propulsion unit 100 to an end of the dual shaft 300 and disposing the contra-rotating propulsion unit 100 outside a stern of the hull 10.

In step S100, the dual-rotor electric motor 200 configured to supply rotational power to the contra-rotating propulsion unit 100 may be disposed inside the hull 10.

In particular, in step S100, a rotor 210 and a stator 220 sequentially may be sequentially arranged in a pair in the dual-rotor electric motor 200 disposed inside the hull 10, wherein the rotor 210 may be configured to operate through induced power.

In step S100 of the manufacturing method according to an exemplary embodiment of the present disclosure, the rotor 210 and the stator 220 may be arranged in two layers in the dual-rotor electric motor 200 to generate rotational power corresponding to the rotational directions of the propellers of the contra-rotating propulsion unit 100.

By arranging the rotor 210 and the stator 220 in two layers in the dual-rotor electric motor 200 in step S100, the rotational directions of the front propeller 110 and the rear propeller 120 of the contra-rotating propulsion unit 100 can be controlled to be opposite to each other.

For example, in step S100, by arranging the rotor 210 and the stator 220 in two layers in the dual-rotor electric motor 200, the front propeller 110 may rotate in one direction, while the rear propeller 120 may rotate in another direction opposite to the one direction.

In step S200, the dual shaft 300 may be connected to an end of the dual-rotor electric motor 200 that was disposed inside the hull 10 in step S100.

In particular, in step S200, the dual shaft 300 may be connected to an end of the dual-rotor electric motor 200 and may extend to a stern boss of the hull 10 from the dual-rotor electric motor 200.

In step S200, the dual shaft 300 may be connected to the end of the dual-rotor electric motor 200. The dual shaft 300 may include an outer shaft 310 and an inner shaft 320 that which rotate in opposite directions to each other.

In addition, in step S200, a bearing configured to support the outer shaft 310 and the inner shaft 320 may be arranged at one side where the outer shaft 310 meets the hull 10.

In step S300, the contra-rotating propulsion unit 100 may be arranged on the second side of the dual shaft 300 opposite to the first side of the dual shaft 300, where first side of the dual shaft 300 is connected to the dual-rotor electric motor 200 and the second side of the dual shaft 300 is located at the stern boss of the hull 10.

In particular, in step S300, the contra-rotating propulsion unit 100 may be mounted on the dual shaft 300 located at the stern boss of the hull 10, and thus may be directly connected to the hull 10.

In other words, in the method for manufacturing the hull-directed propulsion system 1000 of the contra-rotating propulsion unit according to an exemplary embodiment of the present disclosure, by disposing the dual-rotor electric motor 200 and the dual shaft 300 inside the hull 10, a gearbox for reversing rotation can be eliminated from the driving shaft that rotates the propellers, thus facilitating vessel maintenance.

In addition, by disposing the contra-rotating propulsion unit 100 at the end of the dual shaft 300 located at the stern boss of the hull 10, it is possible to reduce inflow disturbance caused by other structures of the hull (e.g., a housing or a strut), thereby increasing the propulsion efficiency of the contra-rotating propulsion unit 100.

In the above, although several preferred embodiments of the present disclosure have been described with some examples, the descriptions of various exemplary embodiments described in the "Specific Content for Carrying Out the Invention" item are merely exemplary, and it will be appreciated by those skilled in the art that the present disclosure can be variously modified and carried out or equivalent executions to the present disclosure can be performed from the above description.

In addition, since the present disclosure can be implemented in various other forms, the present disclosure is not limited by the above description, and the above description is for the purpose of completing the disclosure of the present disclosure, and the above description is just provided to completely inform those skilled in the art of the scope of the present disclosure, and it should be known that the present disclosure is only defined by each of the claims.

LIST OF REFERENCE NUMBERS

10: hull
100: contra-rotating propulsion unit
110: front propeller
120: rear propeller
200: dual rotor electric motor
210: rotor
212: outer rotor
214: inner rotor
220: stator
222: outer coil
224: inner coil
300: dual shaft
310: outer shaft
320: inner shaft
1000: hull-directed propulsion system of contra-rotating propulsion unit

What is claimed is:

1. A hull-directed propulsion system of a contra-rotating propulsion unit, comprising:

a contra-rotating propulsion unit including a front propeller and a rear propeller;

a dual-rotor electric motor configured to generate rotational directions of the front propeller and the rear propeller, respectively; and a dual shaft connecting the contra-rotating propulsion unit and the dual-rotor electric motor, wherein the dual-rotor electric motor is configured such that a plurality of rotors and a plurality of stators are sequentially arranged in pairs to rotate the contra-rotating propulsion unit, the plurality of rotors being configured to operate through induced power, and wherein the plurality of rotors includes:

an outer rotor disposed on an outer side of the dual-rotor electric motor and configured to rotate in one direction; and an inner rotor configured to rotate in another direction opposite to the one direction, wherein each of the outer rotor and the inner rotor includes a permanent magnet or a rotor core, wherein the plurality of stators is disposed between the outer rotor and the inner rotor, the plurality of stators including an outer coil configured to control the outer rotor and an inner coil configured to control the inner rotor, wherein the outer coil and the inner coil are arranged to be spaced apart from each other to independently control the outer rotor and the inner rotor, respectively, with a space formed between the outer coil and the inner coil to reduce magnetic interference therebetween, wherein the dual shaft includes an outer shaft and an inner shaft that rotate in opposite directions, the outer shaft being connected to the outer rotor, and the inner shaft being connected to the inner rotor, and wherein a plurality of bearings are disposed between the plurality of stators and the plurality of rotors to rotatably support the outer rotor and the inner rotor, respectively.

2. The system of claim 1, wherein the contra-rotating propulsion unit is connected to the dual shaft located at a stern of a hull and is disposed outside the stern.

3. The system of claim 2, wherein the contra-rotating propulsion unit is configured such that the front propeller and the rear propeller are disposed on the dual shaft and rotate in opposite directions, respectively.

4. The system of claim 1, wherein the dual shaft is connected to an end of the dual-rotor electric motor, wherein one side of the dual shaft is configured to rotate in one direction, and wherein another side of the dual shaft is configured to rotate in another direction opposite to the one direction.

5. The system of claim 1, wherein the dual shaft includes a bearing disposed at one side where the outer shaft meets the hull, the bearing being configured to support the outer shaft and the inner shaft.

6. A method for manufacturing a hull-directed propulsion system of a contra-rotating propulsion unit, comprising:

(a) disposing a dual-rotor electric motor inside a hull, the dual-rotor electric motor being configured to generate respective rotational directions of a front propeller and a rear propeller of the contra-rotating propulsion unit;

(b) disposing a dual shaft inside the hull, the dual shaft being connected to an end of the dual-rotor electric motor; and (c) connecting the contra-rotating propulsion unit to an end of the dual shaft and disposing the contra-rotating propulsion unit outside a stern of the hull, wherein, in step (a), the dual-rotor electric motor is configured such that a plurality of rotors and a plurality of stators are sequentially arranged in pairs to rotate the contra-rotating propulsion unit, the plurality of rotors being configured to operate through induced power, wherein the plurality of rotors includes:

an outer rotor disposed at an outer side of the dual-rotor electric motor and configured to rotate in a first direction; and an inner rotor configured to rotate in a second direction opposite to the first direction, wherein each of the outer rotor and the inner rotor includes a permanent magnet or a rotor core, wherein the plurality of stators is disposed between the outer rotor and the inner rotor, the plurality of stators including an outer coil configured to control the outer rotor and an inner coil configured to control the inner rotor, wherein the outer coil and the inner coil are arranged to be spaced apart from each other to independently control the outer rotor and the inner rotor, respectively, with a space formed between the outer coil and the inner coil to reduce magnetic interference therebetween, wherein the dual shaft includes an outer shaft and an inner shaft that rotate in opposite directions, respectively, the outer shaft being connected to the outer rotor, and the inner shaft being connected to the inner rotor, and wherein a plurality of bearings are disposed between the plurality of stators and the plurality of rotors to rotatably support the outer rotor and the inner rotor, respectively.

* * * * *